US010871012B2

(12) United States Patent
Zaerr et al.

(10) Patent No.: US 10,871,012 B2
(45) Date of Patent: Dec. 22, 2020

(54) END DOOR LATCH ARRANGEMENT FOR RAILROAD CAR

(71) Applicant: Gunderson LLC, Portland, OR (US)

(72) Inventors: Jon B. Zaerr, Portland, OR (US); Cory L. McGhehey, Beaverton, OR (US)

(73) Assignee: Gunderson LLC, Portland, OR (US)

( * ) Notice: Subject to any disclaimer, the term of this patent is extended or adjusted under 35 U.S.C. 154(b) by 233 days.

(21) Appl. No.: 16/110,935

(22) Filed: Aug. 23, 2018

(65) Prior Publication Data

US 2020/0063469 A1 Feb. 27, 2020

(51) Int. Cl.

*E05B 83/10* (2014.01)
*E05B 77/44* (2014.01)
*E05B 67/38* (2006.01)

(52) U.S. Cl.

CPC ..... *E05B 83/10* (2013.01); *E05B 67/383* (2013.01); *E05B 77/44* (2013.01); *E05Y 2900/51* (2013.01)

(58) Field of Classification Search

CPC ..... E05B 83/10; E05B 67/383; E05B 13/00; E05B 65/16; E05B 77/44; E05Y 2900/51; E05C 19/18

USPC ..... 70/2, 91, 14, 56–58, 202, 212, DIG. 43, 70/417; 292/218, 259 R, DIG. 32

See application file for complete search history.

(56) References Cited

U.S. PATENT DOCUMENTS

| | | | | |
|---|---|---|---|---|
| 4,082,330 | A * | 4/1978 | McWhorter | E05B 83/10 292/218 |
| 4,290,232 | A * | 9/1981 | Shook | E05B 83/02 49/277 |
| 4,344,366 | A | 8/1982 | Madland | |
| 4,389,862 | A | 6/1983 | Hastings | |
| 4,390,196 | A * | 6/1983 | Madland | E05B 83/02 292/66 |
| 4,522,436 | A | 6/1985 | Hoen et al. | |
| 5,259,221 | A | 11/1993 | Whitmore | |
| 5,284,036 | A | 2/1994 | Rosenbaum | |
| 5,701,768 | A | 12/1997 | Khalsa | |
| 5,735,146 | A | 4/1998 | Taplin | |
| 5,934,116 | A | 8/1999 | Moore | |
| 6,010,166 | A | 1/2000 | Hamilton et al. | |
| 6,233,984 | B1 * | 5/2001 | Blehi, III | E05B 13/002 70/2 |
| 6,357,266 | B1 * | 3/2002 | Van Buren | E05B 83/10 70/211 |

(Continued)

FOREIGN PATENT DOCUMENTS

| | | | |
|---|---|---|---|
| WO | 2006034226 | A2 | 3/2006 |
| WO | 2012038758 | A1 | 3/2012 |

*Primary Examiner* — Suzanne L Barrett
(74) *Attorney, Agent, or Firm* — Chernoff Vilhauer LLP

(57) ABSTRACT

Apparatus for securely fastening both of a pair of doors, such as the doors at an end of an auto rack railroad car, in a closed condition, using a single lock. A hasp mounted on one of the doors can be locked in a securing position in which locking members prevent the locking rod handles from being removed from receptacles that hold the locking rod handles with the locking rods in door-latching positions when the doors are closed. The hasp thus prevents the locking rod handles from being moved to rotate the locking rods from their door-latching positions. A single lock can prevent the hasp from being moved and thus prevent both locking rod handles from being moved.

20 Claims, 9 Drawing Sheets

(56) References Cited

U.S. PATENT DOCUMENTS

| | | | | |
|---|---|---|---|---|
| 6,464,269 | B1 * | 10/2002 | Wilhelm | E05B 39/00 292/281 |
| 6,508,087 | B2 | 1/2003 | Lemley et al. | |
| 6,553,798 | B1 | 4/2003 | Larsen et al. | |
| 6,581,419 | B1 | 6/2003 | Strodtman | |
| 6,623,223 | B1 | 9/2003 | Wrobley et al. | |
| 6,708,532 | B2 | 3/2004 | Winland | |
| 6,834,896 | B2 | 12/2004 | Smith | |
| 6,928,843 | B1 | 8/2005 | Pirnie | |
| 7,182,569 | B2 | 2/2007 | Wrobley et al. | |
| 7,210,316 | B1 | 5/2007 | Falconer et al. | |
| 7,380,846 | B1 | 6/2008 | Moreno | |
| 7,441,425 | B2 | 10/2008 | Jeong | |
| 8,011,213 | B1 | 9/2011 | Gogel | |
| 2004/0031297 | A1 * | 2/2004 | Winland | E05B 67/38 70/2 |
| 2005/0144991 | A1 * | 7/2005 | Bravo | E05B 13/002 70/56 |
| 2010/0037664 | A1 | 2/2010 | Pitisethakarn | |
| 2010/0326145 | A1 | 12/2010 | Powers et al. | |
| 2012/0103030 | A1 * | 5/2012 | Boesel | G09F 3/0317 70/2 |
| 2012/0103032 | A1 * | 5/2012 | Thomsen | E05B 67/383 70/14 |
| 2012/0210754 | A1 * | 8/2012 | Thomsen | E05B 83/10 70/14 |
| 2012/0240642 | A1 * | 9/2012 | Senn | E05B 67/383 70/101 |
| 2015/0075231 | A1 * | 3/2015 | Waugh | E05B 83/12 70/2 |
| 2018/0313110 | A1 * | 11/2018 | Pare | E05B 13/001 |
| 2019/0010739 | A1 * | 1/2019 | Jung | E05B 63/246 |
| 2020/0115934 | A1 * | 4/2020 | Dolnik | E05B 77/16 |

* cited by examiner

END DOOR LATCH ARRANGEMENT FOR RAILROAD CAR

BACKGROUND OF THE INVENTION

The present invention relates to securely fastening a pair of doors, and in particular, to an apparatus for securely locking a pair of doors on the end of a container such as an auto rack railroad car.

Various types of containers such as intermodal cargo containers and railroad freight cars such as auto racks have a pair of doors that swing apart from each other to open the end of the container. Such doors are usually held shut, with their vertical edges alongside each other, by dogs at the top and bottom of vertical locking rods mounted externally on the doors so that they can be rotated to engage the dogs with catches mounted on the top and bottom members of the doorway.

Several different arrangements have been used to provide physically secure closure of such doors, including arrangements that provide for locking the handles for the locking rods to the doors on which the locking rods are mounted. In other arrangements removable retainers are locked to the locking rods, extending from one to the other, to prevent the doors from being opened without removing the retainers.

Various attachments have been devised to protect locks used to securely fasten such doors or the removable retainers used with such doors, to prevent access to the locks by would-be thieves.

While such previously known apparatus may provide adequate security, there are disadvantages to such apparatus, such as complex construction and difficulty in use, the possible loss of parts of removable retainers, or the need for multiple locks and seals to prevent opening or provide clear evidence of tampering with the doors of the containers.

What is desired, then, is easily constructed, permanently installed and easily operated apparatus for securely locking such a pair of doors on an end of a container, requiring but a single lock.

SUMMARY OF THE INVENTION

The door-fastening apparatus disclosed herein provides an answer to the above-mentioned disadvantages of the conventional apparatus for securing a pair of doors on the end of a container such as an intermodal cargo container or a railroad freight car such as an auto rack railroad car.

In one embodiment of the door fastening apparatus disclosed herein, locking rods, vertical shafts mounted on the doors so as to move dogs into engagement with catches, are equipped with locking rod handles arranged to rotate the locking rods. A hasp is mounted on one of the doors in such a way as to engage both of the locking rod handles when the doors are closed and the dogs are engaged with the catches, and the hasp can be locked in a position which prevents the locking rods from being rotated to release the dogs from the catches.

In one embodiment of the apparatus disclosed herein a single lock securely holds the hasp in a position keeping the doors securely fastened shut.

In one embodiment of the apparatus disclosed herein the hasp is mounted on one of the doors so that it can be swung about a pivot axis oriented parallel with the door but at an oblique angle with respect to the horizontal, so that the hasp can hang parallel with a face of the door when it is not in position to engage the handles of the locking rods.

In one embodiment of the apparatus disclosed herein, an opening is defined in the hasp, and each of the locking rod handles includes a locking member that is held in the opening defined in the hasp when the hasp is in a securing position to prevent the locking rod handles from being moved so as to disengage the dogs from the catches.

The foregoing and other objectives and features of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
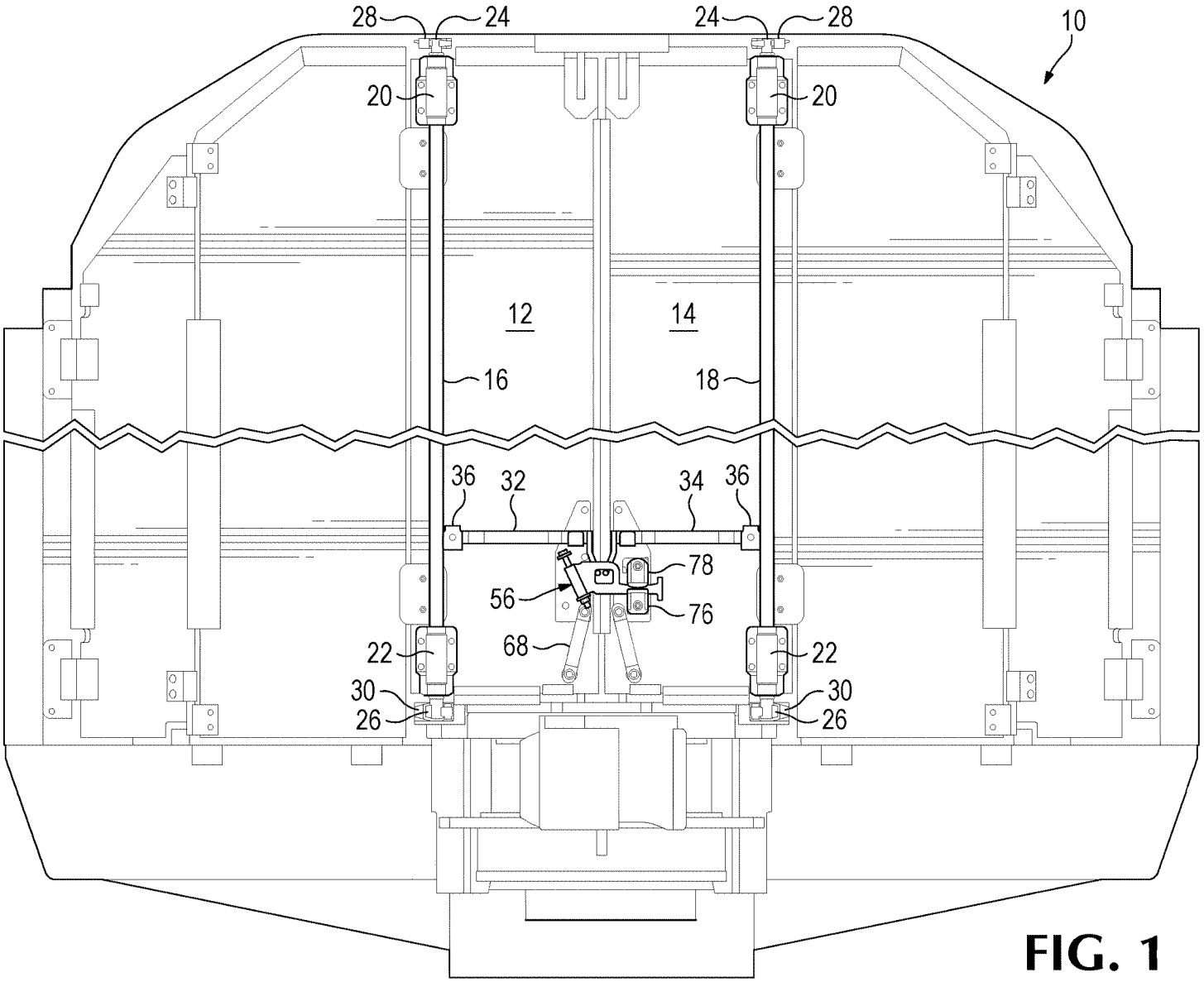
FIG. 1 is a partial end elevational view of an automobile-carrying railroad freight car including a locking apparatus for an end door latching arrangement that is an exemplary embodiment of the invention disclosed herein.
Figure 2:
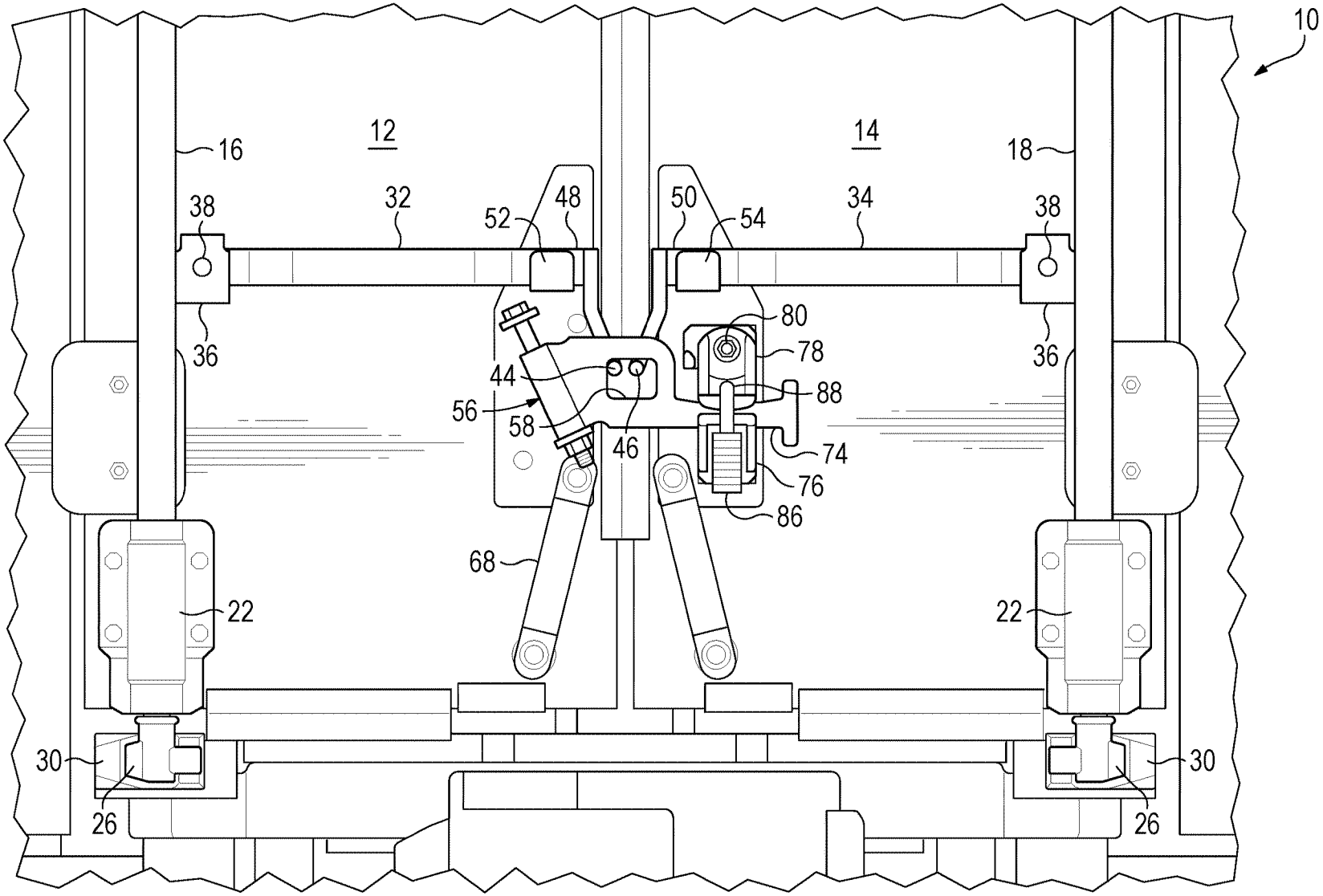
FIG. 2 is an end elevational view of a portion of the railroad freight car shown in FIG. 1, including the locking apparatus for an end door latching arrangement in a locked condition, and shown at an enlarged scale.

Referring now to the drawings that form a part of the disclosure herein, in FIGS. 1 and 2 a railroad freight car 10 of the type commonly referred to as an auto rack includes a pair of end doors 12 and 14 shown closed and locked. A pair of locking rods 16 and 18 extend vertically from top to bottom of the doors 12 and 14. The locking rods 16 and 18 are mounted respectively on the doors 12 and 14 in bearings 20 and 22 that permit the locking rods 16 and 18 to be rotated about their longitudinal, vertical axes, and dogs 24 and 26 at the upper and lower ends of the locking rods can be engaged with respective catches 28 and 30 mounted on the structures defining the top and bottom of the opening in which the doors 12 and 14 are mounted. After the doors 12 and 14 have been closed the locking rods 16 and 18 can be rotated to respective door-latching positions, as shown in FIGS. 1 and 2, in which the dogs 24 and 26 are engaged with the catches 28 and 30 and prevent the doors 12 and 14 from being opened.

Figure 3:
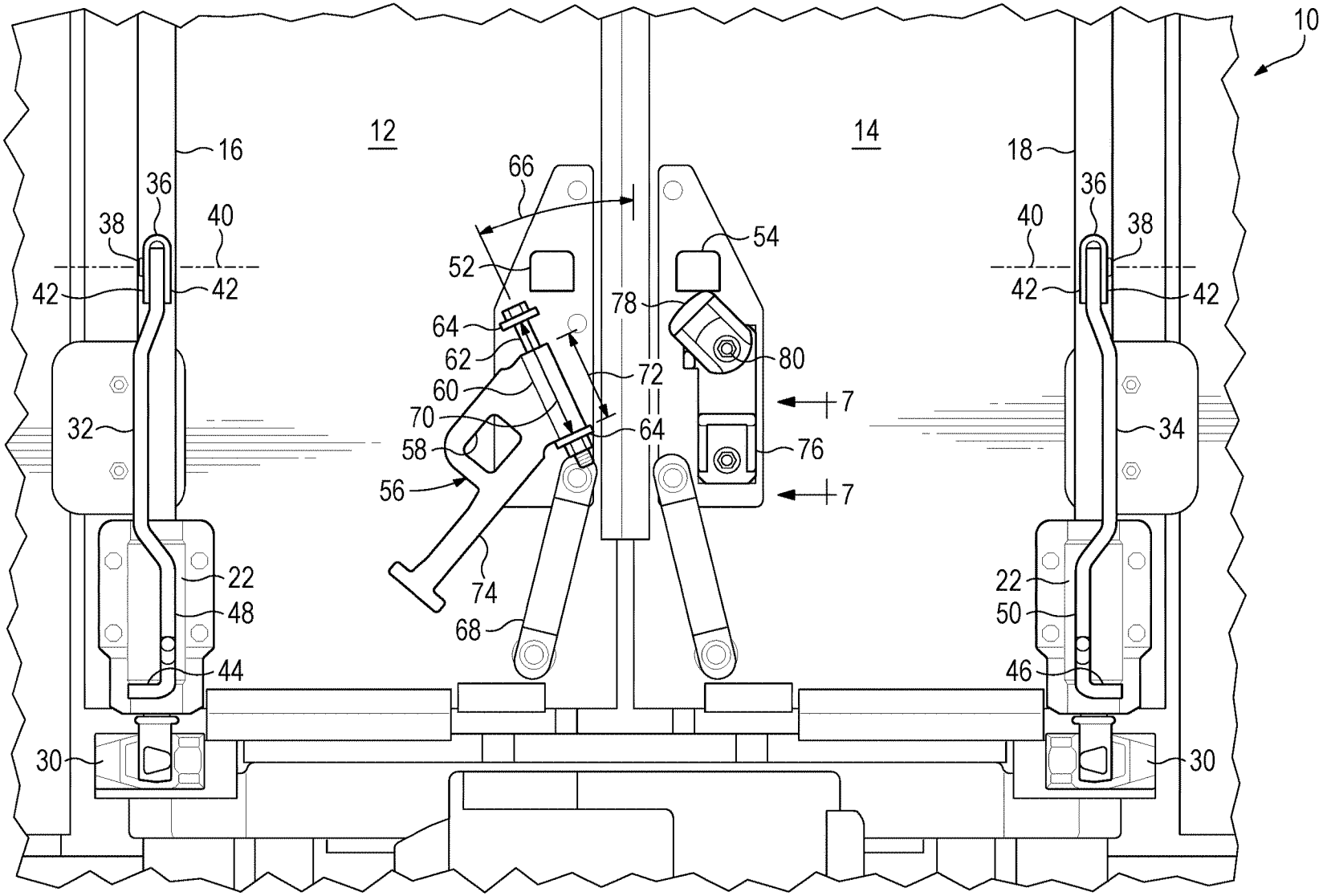
FIG. 3 is an end elevational view of the same portion of the railroad freight car shown in FIG. 2, showing the locking apparatus for the end door latching arrangement in an open, unlocked, condition.
Figure 5:
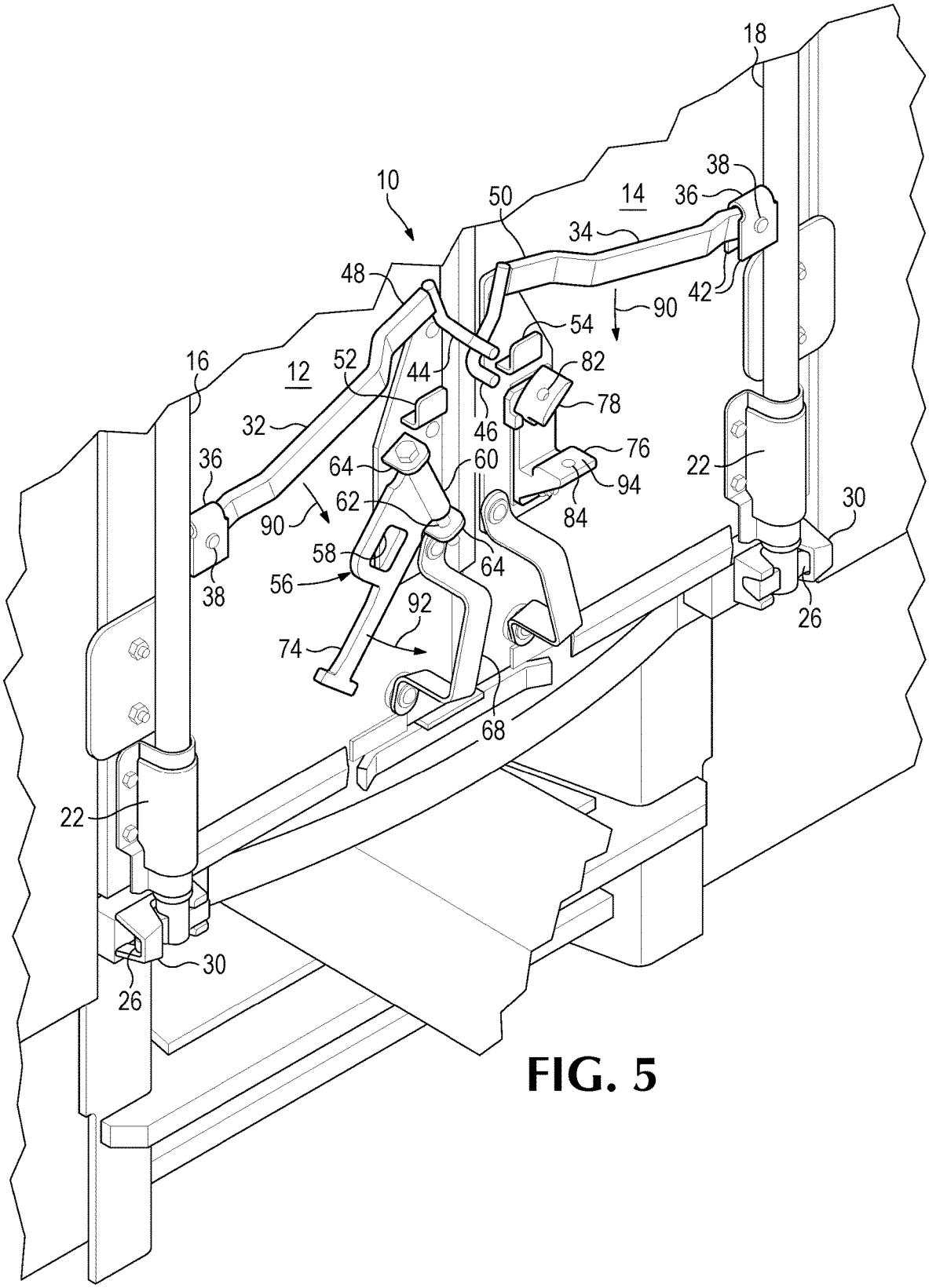
FIG. 5 is a view similar to FIG. 4, but showing the doors latched and showing the locking apparatus in an intermediate stage of the process of being locked.

In order to rotate the locking rods 16 and 18 a respective handle 32 or 34 is attached to each of the locking rods 16 and 18, as by a bracket 36, fastened to the respective locking rod 16 or 18 as by being welded to the locking rod. Preferably, each handle 32 or 34 is connected with the respective bracket 36 through a pivot 38 with a horizontal pivot axis 40, so that each handle 32 or 34 can rotate between a raised attitude, above the horizontal as shown in FIG. 5, and a depending, generally vertical orientation as shown in FIG. 3. Each bracket 36 may include a pair of parallel ears 42, and the handle 32 or 34 may have an end portion extending between the parallel ears 42. The pivot 38 may include a pivot pin such as a rivet, or a pin welded in place and extending through the bracket ears 42 and a suitable hole through the handle 32 or 34.

The handles 32 and 34 include locking members 44 and 46 that in the embodiment depicted herein are in the form of bent rods that may also be referred to as locking fingers. The locking members 44 and 46, may, for example, be welded to the outer end 48 or 50 of the respective handle 32 or 34. When the doors 12 and 14 are closed and latched by engagement of the dogs 24 and 26 with the catches 28 and 30 each of the handles 32 and 34 may be oriented horizontally, as shown in FIGS. 1 and 2, extending closely along the outer face of the respective door 12 or 14 with which it is associated. The outer ends 48 and 50 are each supported by a respective handle receptacle 52 or 54 mounted on the outer face of the door 12 or 14. The handle receptacles may, for example, be simple brackets welded to the outer face of the door 12 and 14.

To avoid having to use a separate lock to secure each of the handles 32 and 34 separately, a hasp 56 engages the locking fingers 44 and 46 to hold both of the handles 43 and 45 and prevent them from being moved far enough to disengage the dogs 24 and 26 from the catches 28 and 30. The hasp 56 defines an opening 58 in which both of the locking fingers 44, 46 are held when the hasp 56 is in the secured, locking, position shown in FIGS. 1 and 2. It will be understood that locking members 44 and 46 may be of different construction but must include portions projecting from the outer ends 48 and 50 of the handles 32 and 34 and available to extend through and be engaged in the opening 58 when the hasp 56 is in the engaged position shown in FIGS. 1 and 2.

The hasp 56 is an adequately strong member that may, for example, be of metal plate construction. The hasp may be attached to one of the doors 12 or 14 by a hinge-like hasp pivot such as a tubular portion through which a pivot pin 62 extends at a rear end 60 of the hasp 56, defining an axis about which the hasp 56 can pivot. Preferably, the pivot pin 62 is held by a pair of supports such as ears 64 of adequate strength, attached permanently to the left door 12, as by welding, so as to support the pivot pin 64 spaced slightly outward from the door. The pivot pin 62 may preferably be parallel with the outer face of the door 12 and oriented at an oblique angle 66 with respect to the longitudinal, vertical axes of the locking rods 16 and 18, so that when the hasp 56 is not in the engaged position shown in FIG. 2 it can hang downward parallel with the outer surface of the door 12, as shown in FIG. 3. As shown in FIG. 3, the orientation of the pivot pin 62 and the orientation of the tubular portion at the rear end 60 of the hasp 56 may provide for the hasp 56 to hang where it is spaced somewhat apart from the handle 68 on the door 12, so as not to obstruct access to the handle 68 when the hasp 56 is not engaged with the locking rod handles 32 and 34 as shown in FIGS. 1 and 2.

As may be seen in FIG. 2 and FIG. 3, the ears 64 are spaced apart from one another by a distance 70 greater than the width 72 of the rear end 60 of the hasp 56, leaving clearance above the rear end 60 of the hasp 56 for the hasp 56 to move along the pivot pin 62. Also, there is clearance within the opening 58 defined in the hasp, beneath the locking fingers 44 and 46 of the locking rod handles. The hasp 56 is thus free to move a limited distance along the pivot pin 62 while the locking fingers 44 and 46 extend through the opening 58 and the locking rod handles 32 and 34 are in their receptacles 52 and 54.

In FIGS. 1 and 2, the hasp 56 is shown in its secured position engaging the locking members or locking fingers 44 and 46 of the locking rod handles 32 and 34. The opening 58 is small enough, however, that when the locking members 44 and 46 extend into the opening 58 through the hasp 56 and the hasp is in the secured position shown in FIGS. 1 and 2 there is too little clearance in the opening 58 for the locking rod handles 32 and 34 to be pivoted upwardly about the handle pivots 38 far enough to clear the handle receptacles 52 and 54 and then be swung away from the doors 12 and 14. Moreover, the hasp 56 itself blocks the locking members 44 and 46. The locking rod handles 32 and 34 are thus prevented from rotating the locking rods 16 and 18 far enough disengage the dogs 24 and 26 from the catches 28 and 30 to enable the doors 12 and 14 to be opened when the hasp 56 is in the securing position shown in FIGS. 1, 2, 6, and 8.

As shown in FIGS. 1 and 2, an outer end portion 74 of the hasp 56 is located in a hasp receptacle 76 that acts as a catch and prevents the outer end 74 of the hasp 56 from being moved away from the right door 14. A hasp retainer 78 rests against a top face of the outer end portion 74 of the hasp 56, keeping the hasp 56 from moving upward along the pivot pin 62. The hasp retainer 78 thus keeps the hasp 56 engaged by the hasp receptacle 76 and prevents it from being pivoted about the pivot pin 62 and away from the doors 12 and 14. The hasp retainer 78 is securely attached to the right door 14 by a pivot pin 80 extending away from the door 14 and defining a generally horizontal pivot axis normal to the door 14, about which the hasp retainer 78 can be rotated, between the position shown in FIGS. 1 and 2 and a position such as that shown in FIGS. 3, 4, 5, and 6. With the hasp retainer 78 in the position shown in FIGS. 1 and 2 a pair of apertures such as holes 82 and 84 located respectively in the hasp retainer 78 and the hasp receptacle 76 are aligned with each other so that a padlock 86 can be attached with its shackle 88 engaged in the holes 82 and 84 to prevent the hasp retainer 78 from being rotated away from the position shown in FIG. 2. A single padlock 86 or the like can thus be used to prevent the doors 12 and 14 of the container from being opened without proper authority. A suitable security seal (not shown) can also be attached through the holes 82 and 84 to provide assurance that the hasp retainer 78 has not been moved to allow the hasp 56 to be moved.

Figure 4:
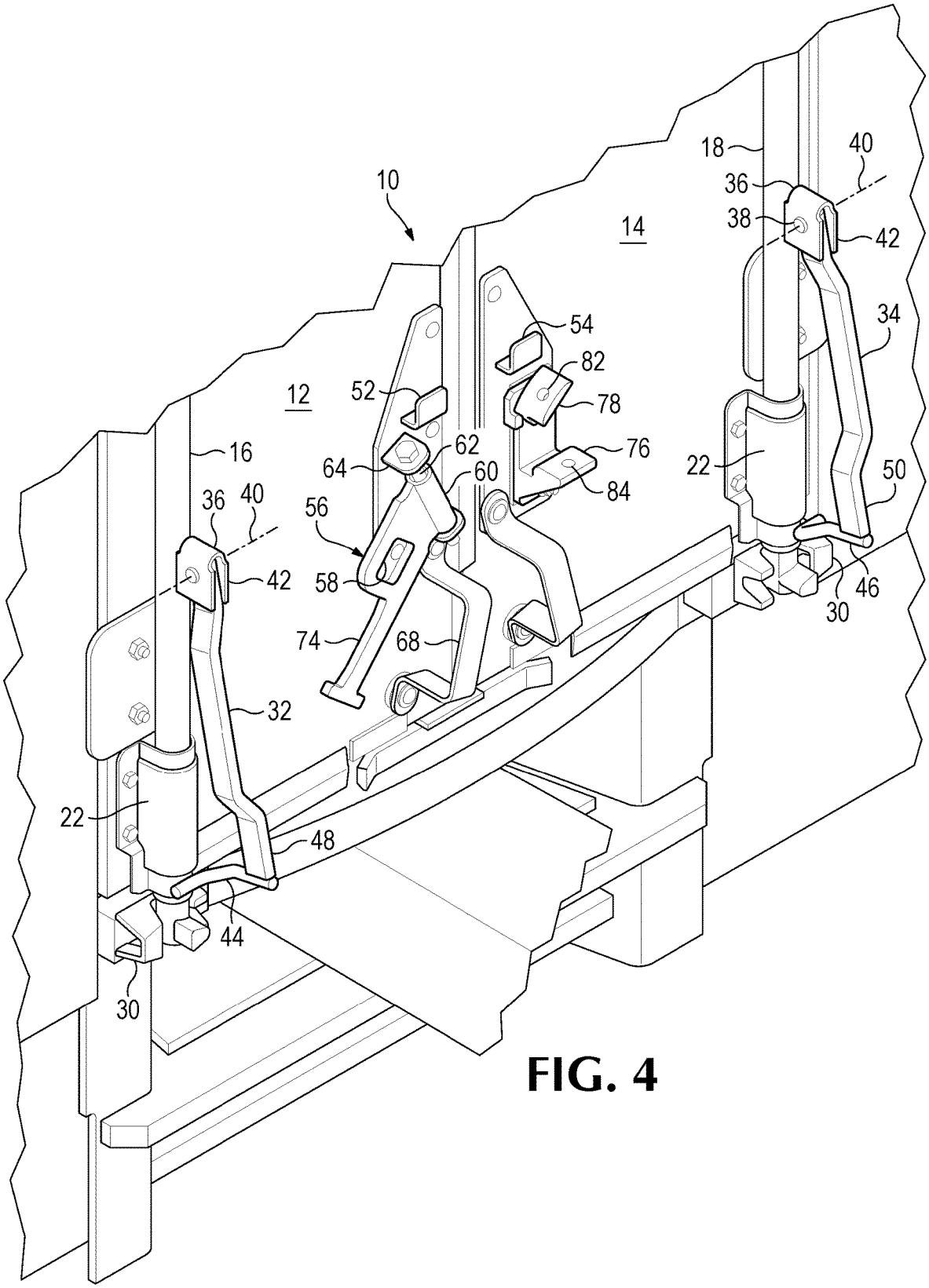
FIG. 4 is an isometric view of the same portion of a railroad freight car shown in FIG. 3, with the locking apparatus in the open, unlocked, condition.

As shown in FIGS. 3-8, once the doors 12 and 14 have been moved to a closed position with respect to the opening at the end of the container, the locking rod handles 32 and 34 may be in a downwardly-hanging orientation as shown in FIGS. 3 and 4, and the hasp 56 may be hanging down alongside the outer face of the left door 12. As shown in FIGS. 3 and 4, the dogs 26 are not yet engaged with the catches 30 at the bottom of the doorway, and the dogs 24 at the top ends of the locking rods 16 and 18 similarly are disengaged from the catches 28 at the top of the doorway.

Figure 6:
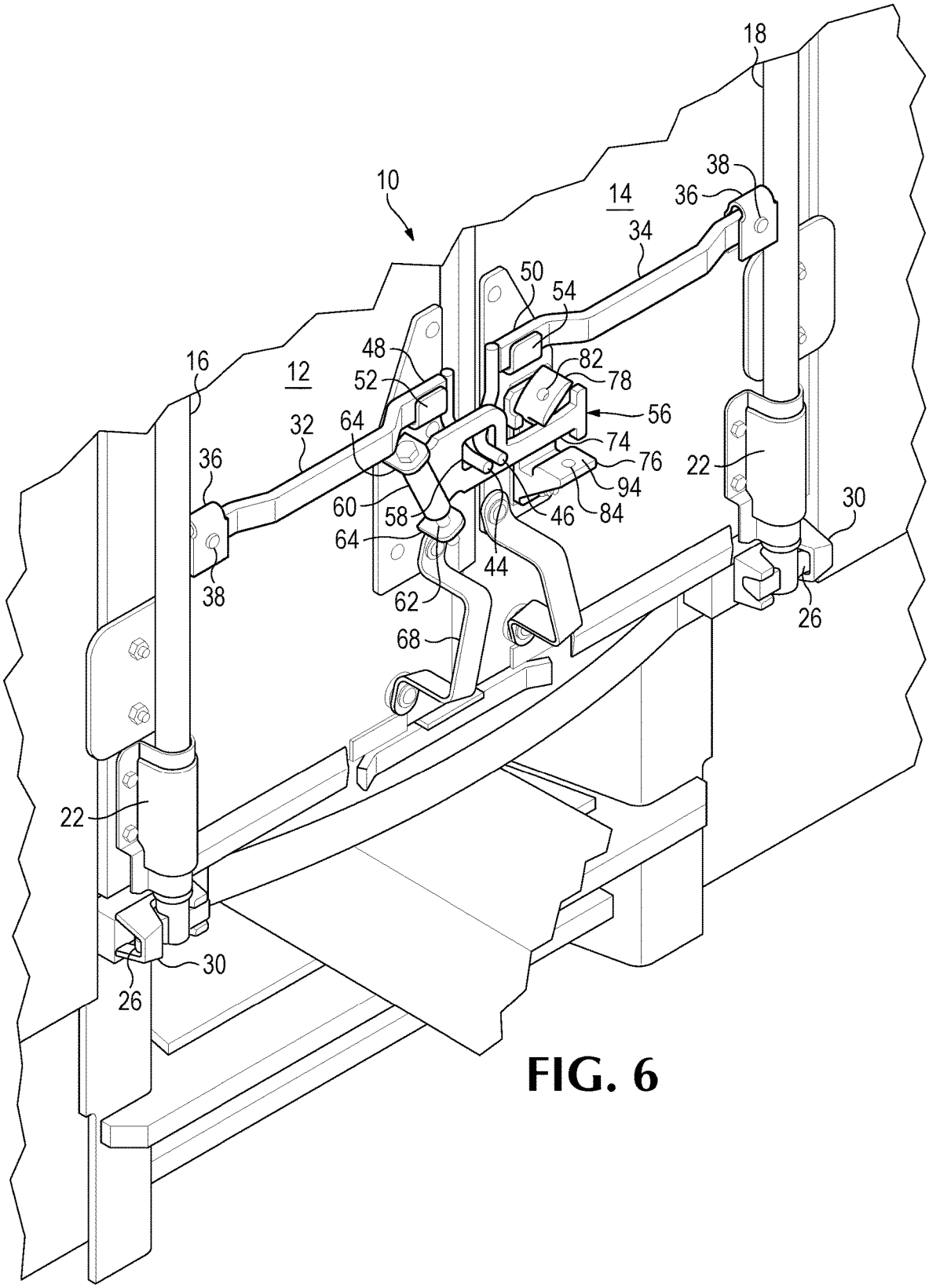
FIG. 6 is a view similar to that of FIG. 5, showing the locking apparatus at a further stage of the process of being locked.

To secure the doors 12 and 14 in the closed position, the locking rod handles 32 and 34 may be raised to a position approaching a horizontal orientation, providing ample leverage, and the handles 32 and 38 are used to rotate the locking rods 16 and 18, thus engaging the dogs 24 and 26 in the catches 28 and 30. The handles 32 and 34 are pivoted upwardly to a position sufficiently above horizontal to allow them to clear the handle receptacles 52 and 54, as shown in FIG. 5, and the handles are then lowered about the pivots 38, as indicated by the arrows 90 in FIG. 5 to place the handles 32 and 34 into the receptacles 52 and 54 as shown in FIG. 6. This brings the locking fingers 44 and 46 together with their fingertip-like portions close together and projecting outward, away from the doors 12 and 14.

Figures 7, 8:
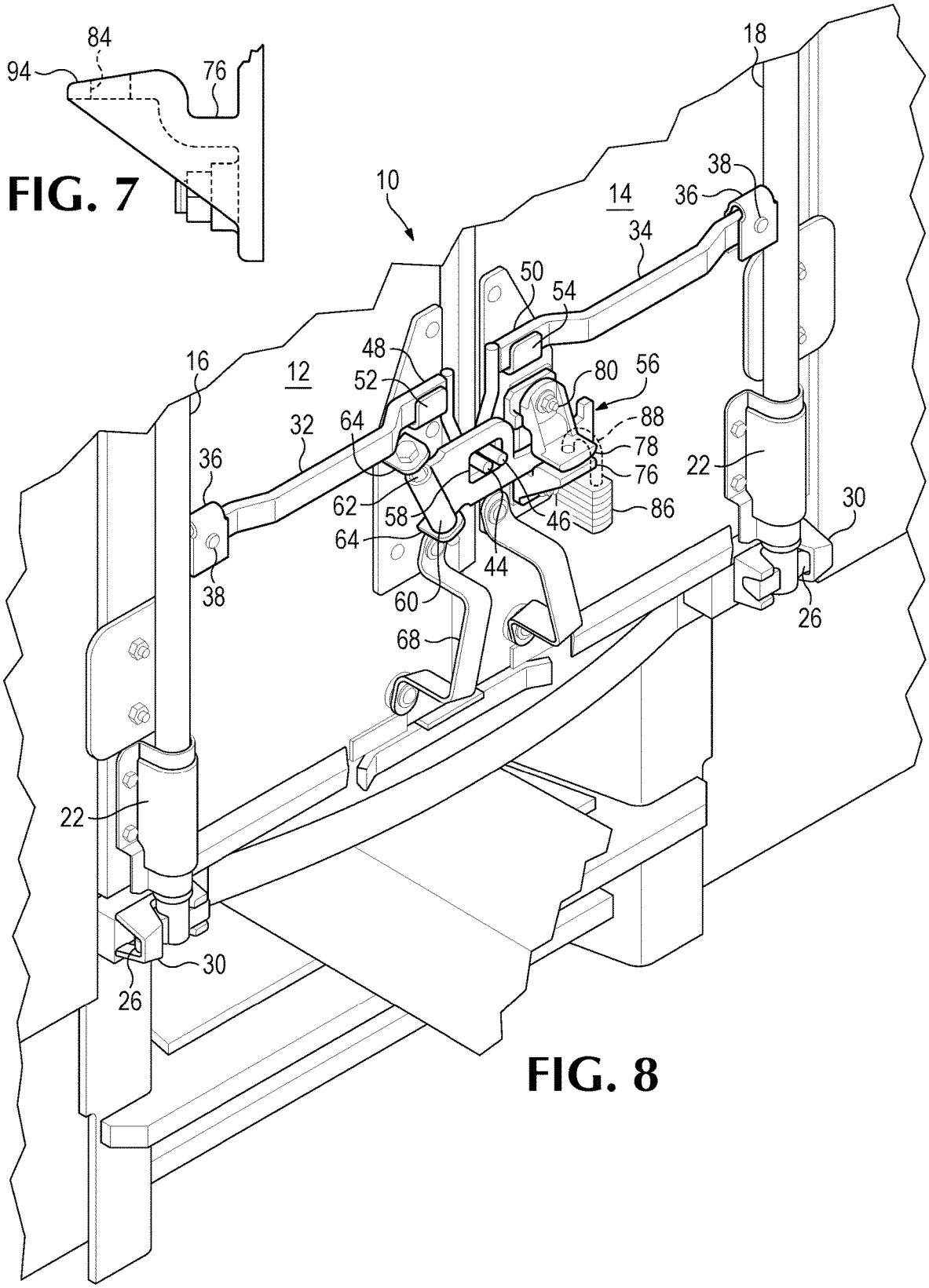
FIG. 7 is a detail view, taken along line 7-7 in FIG. 3.
FIG. 8 is a view similar to FIG. 6, showing the locking apparatus in a fully locked condition.

With the hasp 56 raised to the upper end of the pivot pin 62, as shown in FIG. 5, the hasp 56 is then swung around the pivot pin 62 as indicated by the arrow 92 in FIG. 5 to the position shown in FIG. 6, where the outer end portion 74 of the hasp has passed over the outwardly-extending lip portion 94 of the hasp receptacle 76. It will be seen that with the hasp 56 still located at the upper end of the pivot pin 62, as shown in FIG. 6, the outwardly projecting portions of the locking fingers 44 and 46 of the locking rod handles 32 and 34 extend through the bottom part of the opening 58 through the hasp 56. Referring now also to FIG. 7, it will be seen that the lip portion 94 of the hasp retainer 76 may be sloped to act as a cam so that the hasp 56 will be raised along the pivot pin 62 to the position shown in FIG. 6 as the outer end portion 74 of the hasp 56 passes over the lip portion 94 of the hasp receptacle 76, when the hasp 56 is swung up and across to the securing position it occupies as shown in FIG. 6. Once the hasp has been swung to the position shown in FIG. 6 it is free to slide downward along the pivot pin 62 so that the outer end portion 74 is received into a groove in the hasp receptacle 76, behind the lip portion 94. This prevents the hasp 56 from being rotated outward away from the front surface of the doors 12 and 14. With the outer end portion 74 of the hasp 56 held in the hasp receptacle 76 there is enough clearance for the hasp retainer 78 to be rotated downward to a position above the outer end portion 74, from the position shown in FIG. 6 to the position shown in FIG. 8, where the hasp retainer 78 obstructs movement of the hasp 56 and prevents the outer end portion 74 from escaping from the hasp receptacle 76. The hole 82 in the hasp retainer 78 and the hole 84 in the lip portion 94 of the hasp receptacle 76 are then aligned with each other, ready to receive a seal or a substantial locking element such as the shackle 88 of a padlock 86.

A single lock such as the padlock 86 can then keep the doors 12 and 14 securely locked.

Figure 10:
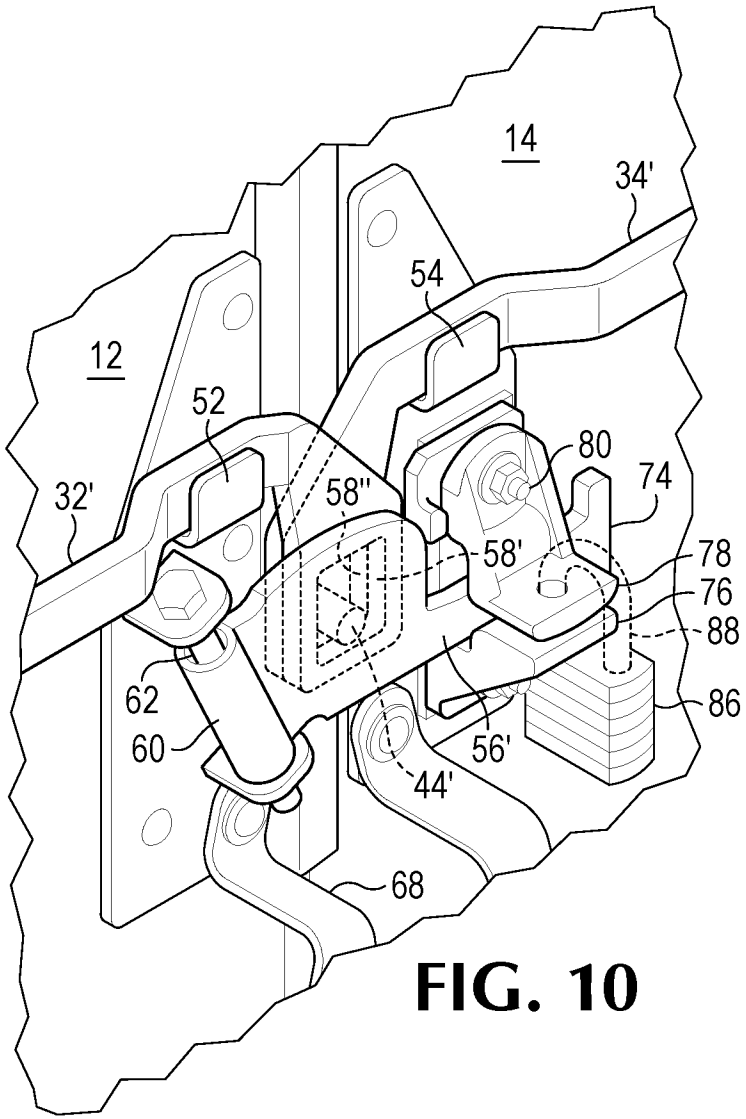
FIG. 10 is a view similar to FIG. 9, showing the locking apparatus in a fully locked condition.
Figure 9:
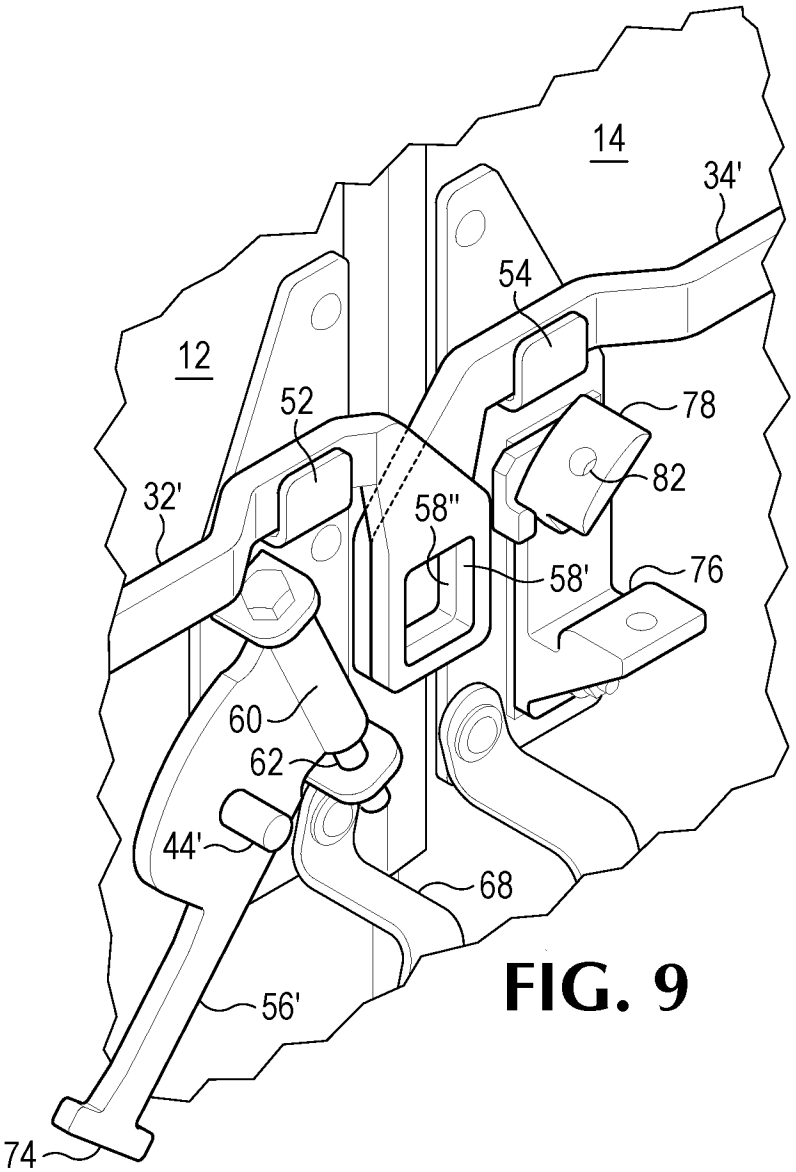
FIG. 9 is an isometric view of a part of the portion of the railroad freight car shown in FIG. 4, but showing a variation of the locking apparatus in the open, unlocked, condition.

It will be understood that as an alternative to providing locking members such as the locking fingers 44 and 46 on the handles 32 and 34 and the opening 58 in the hasp 56, locking members could be incorporated in or mounted on or similarly associated with the hasp, as shown in FIGS. 9 and 10. A locking member 44' is, for example a substantial pin, mounted on and projecting from a back side of a hasp 56'. The locking member 44' is located where it can project into locking engagement in receptacles such as openings 58' and 58" extending through locking rod handles 32' and 34' and thus engage the handles 32' and 34' when the doors 12 and 14 are closed and latched, with the handles 32' and 34' in the receptacles 52 and 54. The handle 32' overlaps the handle 34' and the opening 58" is behind and aligned with the opening 58' in such a way as to receive the locking member 44' extending into and through both openings 58' and 58". While the hasp is located on the pivot pin 62 with enough room to slide along the pivot pin 62 to engage and be held in the hasp receptacle 76, the size and locations of the openings 58' and 58" prevent the handles 32' and 34' from being moved enough to disengage the dogs 24 and 26 from the catches 28 and 30 when such a hasp 56' is secured as shown in FIG. 10, in a position similar to that of the hasp 56 in FIGS. 1, 2, and 8.

Figure 11:
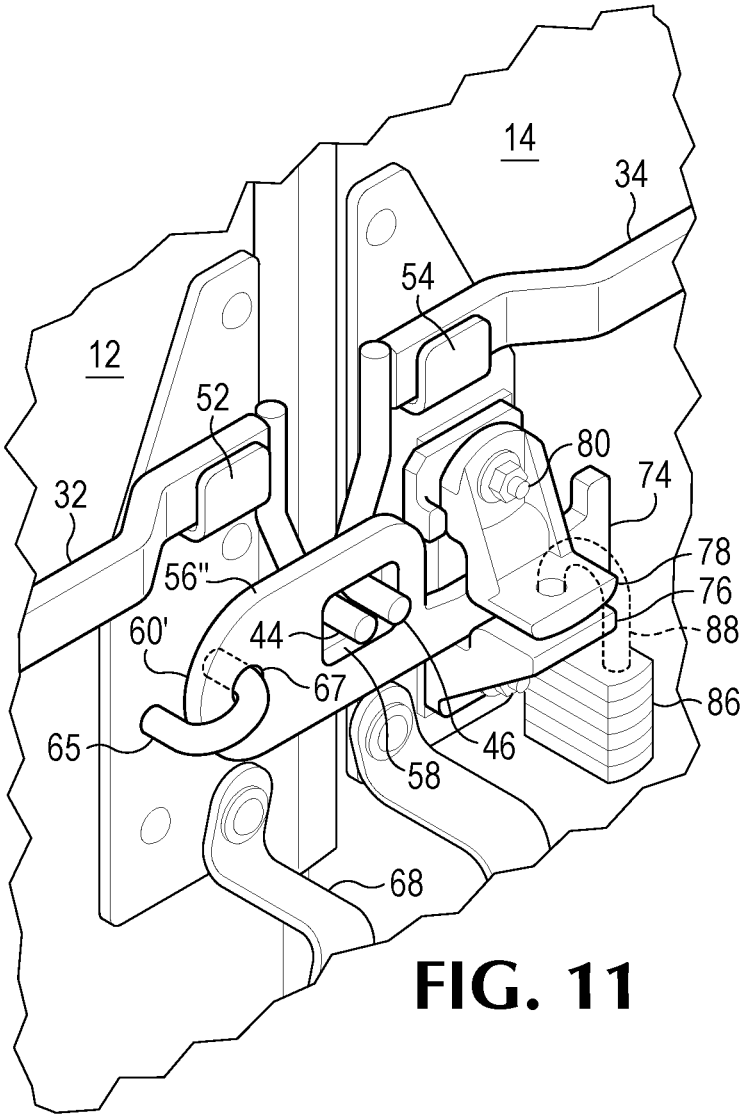
FIG. 11 is an isometric view of the same portion of a railroad freight car as shown in FIGS. 9 and 10, showing another varivation of the locking apparatus in the fully locked condition.

As another alternative to the hasp 56, that is secured to the door 12 by a hinge-like connection to a hasp pivot pin 62, a hasp 56" may be attached to the door 12, as shown in FIG. 11, by a simpler pivot connection such as a strong staple 65 that is mounted on the door 12 and engaged in a corresponding hole 67 through the rear end 60' of the hasp 56". Such an arrangement permits the hasp 56" to be moved into a position where its opening 58 engages the locking members 44 and 46 of the handles 32 and 34, and allows the hasp 56" to pivot with respect to the door 12 and hang downward from the staple 65 when the hasp 56" is not in use to secure the doors 12 and 14.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. Apparatus for locking a pair of doors, comprising:

(a) a pair of locking rods, each having a generally vertically extending longitudinal axis and being mounted on a respective one of the doors so as to be rotatable about its longitudinal axis;

(b) a pair of locking rod handles, a respective one of the locking rod handles being attached to each of the locking rods in a way in which the one of the handles can rotate the rod;

(c) a pair of locking members, a respective one of the locking members extending from each of the locking rod handles; and (d) a sole hasp mounted on one of the doors and disposed between the locking rods, the hasp being movable about a hasp pivot between a disengaged first position and a securing second position in which the hasp engages both the locking members when the locking rods are in respective door-locking positions.

2. The apparatus of claim 1 including a hasp receptacle, located so as to engage the hasp when the hasp is in the securing second position.

3. The apparatus of claim 2 including a hasp retainer attached to one of the doors by a pivot and movable about the pivot to a position in which the hasp retainer engages the hasp and keeps the hasp engaged in the hasp receptacle.

4. The apparatus of claim 1 including a handle receptacle located on each of the doors in a position where the handle receptacle can receive a respective one of the locking rod handles when the locking rod to which the one of locking rod handles is attached has been placed into a door-locking position.

5. The apparatus of claim 4 wherein when the hasp is in the securing second position and one of the locking rod handles is in a respective one of the handle receptacles, the engagement of one of the locking members by the hasp prevents the one of the handles from being moved out of the respective one of the handle receptacles.

6. The apparatus of claim 1 including a hasp retainer attached to one of the doors, the hasp retainer being movable between a first position thereof, in which the hasp retainer provides clearance for movement of the hasp into the securing second position of the hasp, and a second position of the hasp retainer in which the hasp retainer obstructs movement of the hasp away from the second position of the hasp.

7. The apparatus of claim 6 including a hasp receptacle attached to the one of the doors, wherein each of the hasp receptacle and the hasp retainer defines a respective lock receiving aperture and wherein the lock receiving apertures are aligned with each other when the hasp is in the securing second position and the hasp retainer is in the second position of the hasp retainer.

8. The apparatus of claim 1 including a locking point associated with the hasp receptacle, the locking point defining a receptacle for a lock located so that a lock engaged with the locking point prevents removal of the hasp from engagement with the locking members and from the securing second position of the hasp.

9. The apparatus of claim 1 wherein the hasp defines an opening and wherein the locking members extend through the opening and are held within the opening and limit movement of the locking rod handles when the locking rods are in respective door-locking positions and the hasp is in the securing second position thereof.

10. The apparatus of claim 1 wherein the hasp pivot defines a pivot axis oriented in an oblique direction, at an acute angle with respect to the longitudinal axis of the one of the locking rods mounted on the door on which the hasp is mounted.

11. The apparatus of claim 1 wherein the locking members are in the form of fingers, each finger extending from an outer end of a respective one of the locking rod handles.

12. Apparatus for locking a pair of doors, comprising:

(a) a pair of locking rods, each having a generally vertically extending longitudinal axis and being mounted on a respective one of the doors so as to be rotatable about its longitudinal axis;

(b) a pair of locking rod handles, a respective one of the locking rod handles being attached to each of the locking rods in a way in which the one of the handles can rotate the respective locking rod;

(c) a sole hasp mounted on one of the doors and movable between a disengaged first position and a securing second position in which the hasp limits movement of both the locking rod handles when the locking rods are in door-locking positions; and (d) a locking member associated with the hasp and engaged in a locking receptacle defined in at least one of the locking rod handles when the hasp is in the securing second position, wherein end portions of the locking rod handles are adjacent to each other when the locking rods are in the door-locking positions.

13. The apparatus of claim 12 including a hasp receptacle, located so as to engage the hasp when the hasp is in the second securing position.

14. The apparatus of claim 13 including a hasp retainer attached to one of the doors by a pivot and movable about the pivot to a position in which the hasp retainer engages the hasp and keeps the hasp engaged in the hasp receptacle.

15. The apparatus of claim 12 including a handle receptacle located on each of the doors in a position where the handle receptacle can receive a respective one of the locking rod handles when the locking rod to which it is attached has been placed into a door-locking position.

16. The apparatus of claim 15 wherein when the hasp is in the securing second position and one of the locking rod handles is in a respective one of the handle receptacles, the engagement of one of the locking rod handles by the locking member associated with the hasp prevents the one of the locking rod handles from being moved out of engagement in the respective one of the handle receptacles.

17. The apparatus of claim 12 including a hasp retainer attached to one of the doors, the hasp retainer being movable between a first position thereof, in which the hasp retainer provides clearance for movement of the hasp into the securing second position of the hasp, and a second position of the hasp retainer in which the hasp retainer obstructs movement of the hasp away from the second position of the hasp.

18. The apparatus of claim 17 wherein each of the hasp receptacle and the hasp retainer defines a respective lock receiving aperture and wherein the lock receiving apertures are aligned with each other when the hasp is in the securing second position and the hasp retainer is in the second position of the hasp retainer.

19. The apparatus of claim 12 including a locking point associated with the hasp receptacle, the locking point defining a receptacle for a lock located so that a lock engaged with the locking point prevents removal of the locking member associated with the hasp from engagement with the locking rod handle and prevents removal of the hasp from the securing second position of the hasp.

20. The apparatus of claim 12 wherein the locking receptacle in the at least one of the locking rod handles defines an opening and wherein the locking member associated with the hasp extends through the opening and is held within the opening and thereby limits movement of the at least one of the locking rod handles, keeping the locking rod to which the at least one of the locking rod handles is attached in the door-locking position when the locking rods are in respective door-locking positions and the hasp is in the securing second position thereof.

* * * * *